United States Patent [19]

Perner

[11] Patent Number: 4,991,319

[45] Date of Patent: Feb. 12, 1991

[54] SKI SHOE

[75] Inventor: Johann Perner, Graz, Austria

[73] Assignee: Koflach Sport Gesellschaft m.b.H. & Co. KG, Eternitstrasse, Austria

[21] Appl. No.: 404,978

[22] Filed: Sep. 11, 1989

[30] Foreign Application Priority Data

Sep. 9, 1988 [AT] Austria ..... 2222/88

[51] Int. Cl.[5] ..... A43B 5/04; A43B 5/16

[52] U.S. Cl. ..... 36/117; 36/120; 36/121

[58] Field of Search ..... 36/117–121, 36/50

[56] References Cited

U.S. PATENT DOCUMENTS

| | | | |
|---|---|---|---|
| 3,543,421 | 2/1969 | Ader | 36/121 |
| 3,619,914 | 11/1971 | Hanson et al. | 36/121 |
| 3,633,291 | 5/1970 | Caporicci | 36/121 |
| 4,404,758 | 9/1983 | Kopp | 36/121 |
| 4,455,769 | 6/1984 | Fritsch | 36/121 |
| 4,501,078 | 2/1985 | Kopp | 36/121 |
| 4,761,899 | 8/1988 | Marxer | 36/50 X |

FOREIGN PATENT DOCUMENTS 378897 10/1985 Austria .

*Primary Examiner*—Paul T. Sewell
*Assistant Examiner*—M. D. Patterson

[57] ABSTRACT

A ski shoe having a shell and a hinged cuff that can be pivoted on the shell. The shell and cuff are also connected at their heel by a spring and tension member. The tension member is pivotally attached to the shell, and passes through a support surface on the cuff. The tension member engages one end of the spring and the support surfaces engages the other. The support surface on the cuff pivots around an axis intersecting the tension member.

5 Claims, 3 Drawing Sheets

SKI SHOE

Figure 1:
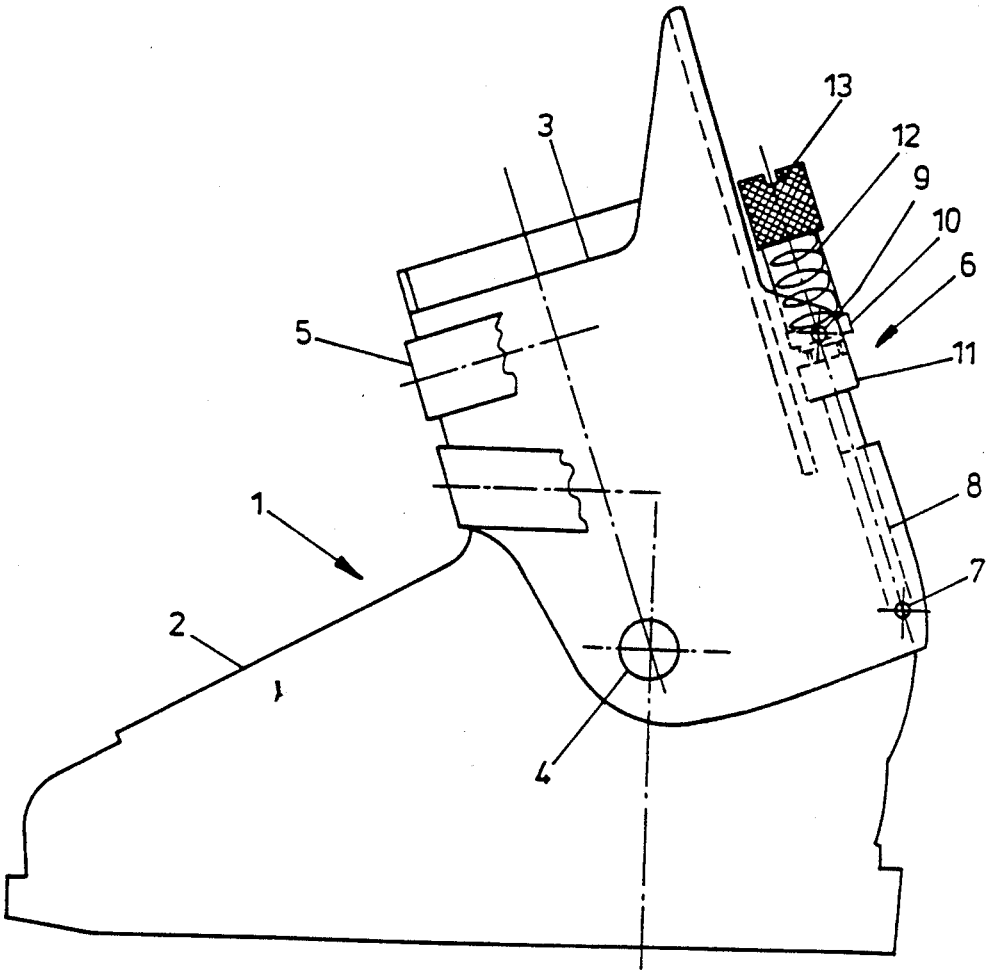

The invention relates to a ski shoe with a shell and an upper or a cuff that is hinged on the shell so that it can be pivoted, in which both shell and upper or cuff are connected to one another in the heel area by a spring element and a tension member engaging the spring element is fastened on the shell so that it can be pivoted, and the tension member passes through a support surface for the spring attached to the upper or the cuff and engages the end of the spring facing away from the support surface.

In ski shoes of the kind named above, as among other things they correspond to models found at present on the market, the tension member is designed as a rod and is hinged on the shell so that it can be pivoted. The bearing or support surface on the upper that can be pivoted or the cuff that can be pivoted can be designed as a one-piece extension with the upper or the cuff which frees a groove or recess running lengthwise or in the direction of the Achilles tendon for the tension rod to pass through. The spring assembly placed above this extension or support surface is supported, on the one hand, on this extension and is overlapped by the tension member on the free end of the tension member. At this place, for example by placing a nut, the initial spring tension can be changed by shortening the tension member. When there is a horizontal swing of the upper or the cuff in the direction of a forward lean such a spring assembly is compressed, and the support forces must be absorbed by the extension of the cuff or the upper. However, depending on the angular position of the upper or the cuff, in such a design the angle between the tension member passing through the support surface and the supporting surface or the spring plate for the spring also changes. If in addition to the tension member an adjustable support in the form of a stop is provided for limiting the maximum backward lean, then depending on the adjustment position of the maximum backward lean this stop also impacts on different angular positions on the support surface on the upper or on the cuff, so that this support surface on the upper or on the cuff, depending on the adjustments selected or the pivoting angle occurring between the shell and the upper, must absorb the off-center eccentric forces, which represent a high material stress of the support surface. Even designing the support surface of material different from that of the upper or the cuff, for example in the form of a metal strap, in this case does not prevent the respective forces, depending on the pivoting position, from going into effect along only one edge of the counterstop for limiting the backward lean or with bending of the spring because of the spring plate that is inclined toward the axis of the tension member at this point.

Now the object of the invention is to provide a design of the kind named above, with which it becomes possible to house even spring assemblies with great spring tension with small components, and particularly without unacceptable overload of plastic bearing blocks, designed as one piece with the pivotable upper or the cuff, in the smallest space possible with little overhang and to be able to absorb correspondingly high support forces without unacceptable overload of the support surface places, without these components having to be made larger. To attain this object the invention essentially consists in supporting the support surface on the upper or the cuff so that it can be pivoted around the axis crossing or intersecting the axis of the tension member. By providing, starting from a design as it is postulated in the introductory clause, a second support place that can be pivoted at the place of the support surface of the cuff that can be pivoted or the upper that can be pivoted, at a relatively short distance from the bearing on the shell a second pivotable support position is placed, whose distance from the first support position on the shell can be considerably shorter that the total length of the tension member and the spring assembly. Because of this reduced distance it is possible to keep the overhang over the back end of the shoe smaller and thus to make it possible to install a spring assembly so that all the components of such a resilient absorption can be integrated into the shell and the back wall area of the cuff or the upper. While in a design, as it has become known from, for example, DE-OS 1 964 402 in connection with a frictionazlly engaged absorption member, each of the two hinge places of the absorber is placed near the free ends of the whole length of such a shock absorber and therefore a relatively large distance must be maintained between the back edge of the shoe and the absorber component, the second pivotable support position through which the tension member passes makes it possible to make the design so that a considerably smaller distance can be selected and the overhang toward the back can be considerably reduced. By now placing this support surface position, which can simultaneously represent the spring plate for the pressure spring and optionally a counterstop for a limiting stop to limit the horizontal swing of the upper of the cuff into the backward lean position, so that it can be pivoted, the off-center forces are considerably reduced and it is ensured that both the spring and an optionally provided limiting stop become effective for limiting the horizontal swing of the upper or the cuff into the backward lean position always in the direction of the axis of the tension member and thus become effective over the entire surface of respective counterstop or spring plate without edging.

Preferably the design according to the invention is chosen in this case so that the support surface is designed as a ring disk through which the tension member is passed, and is mounted so that it can be pivoted by pins located diametrically across from one another or recesses within recesses or on pins of a support block fastened onto the upper or the cuff. In this way a small, stable component is proposed, which can be securely anchored in likewise small support block components, for example integrally molded with the material of the upper or the cuff, which exhibits the corresponding strength characteristics safely to absorb the respective support forces. The pivotable hinge of this support surface designed as a ring disk in this case additionally makes possible even, in the case of lateral horizontal swings of the upper or of the cuff, a certain equalizing possibility by axial shifting of the respective support pins in the corresponding recesses, so that even in these cases no unacceptable, off-center forces are exerted on the support surface. For safe absorption of the forces it is unimportant in this case whether the pins or the accompanying recesses exhibit a certain play, since the respective elastic forces or the forces which occur on collision with the limiting stop for the limiting of backward lean, can always be extensively absorbed by the ring disk.

Advantageously the design according to the invention is made so that the support surface can be set directly with a stop fastened on the tension member for limiting backward lean in effective combination. Particularly with such a design a very simple and small component can be used as a limiting stop for the horizontal swing of the upper or the cuff into the backward lean, which can be formed in the simplest case by a knurled nut.

In the case of placing such a limiting stop for the horizontal swing of the upper or of the cuff into the backward lean position the tension member must be designed as a rod resistent to bending in at least the partial area which carries the stop for limiting backward lean. However, the design according to the invention is advantageously made so that the entire tension member is designed as a rod resistant to bending. In a manner known in the art the design in this case can be made so that the stop for the limitation of backward lean can be fastened to the rod so that it can be adjusted for height.

Figure 2:
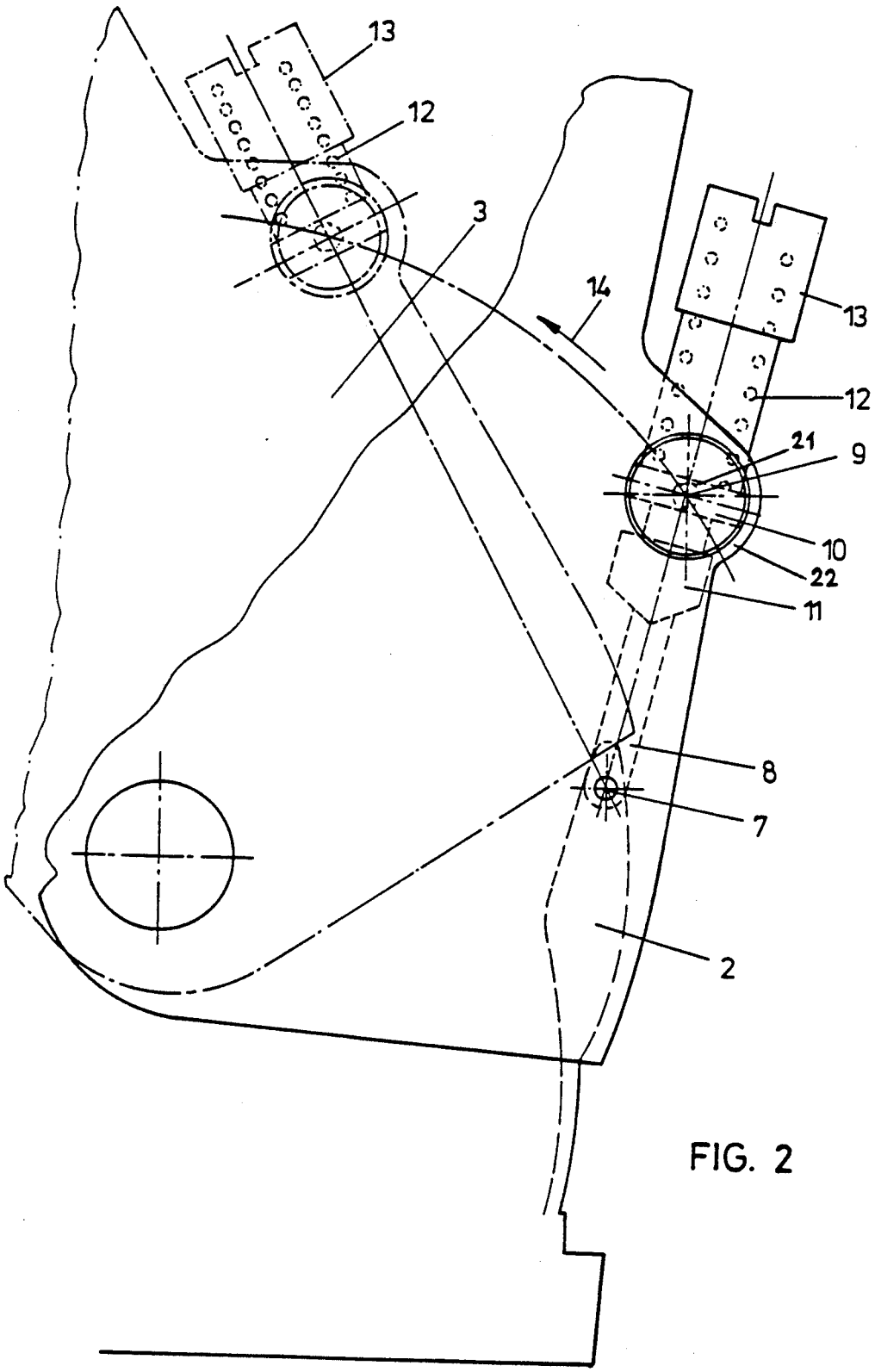
Figure 3:
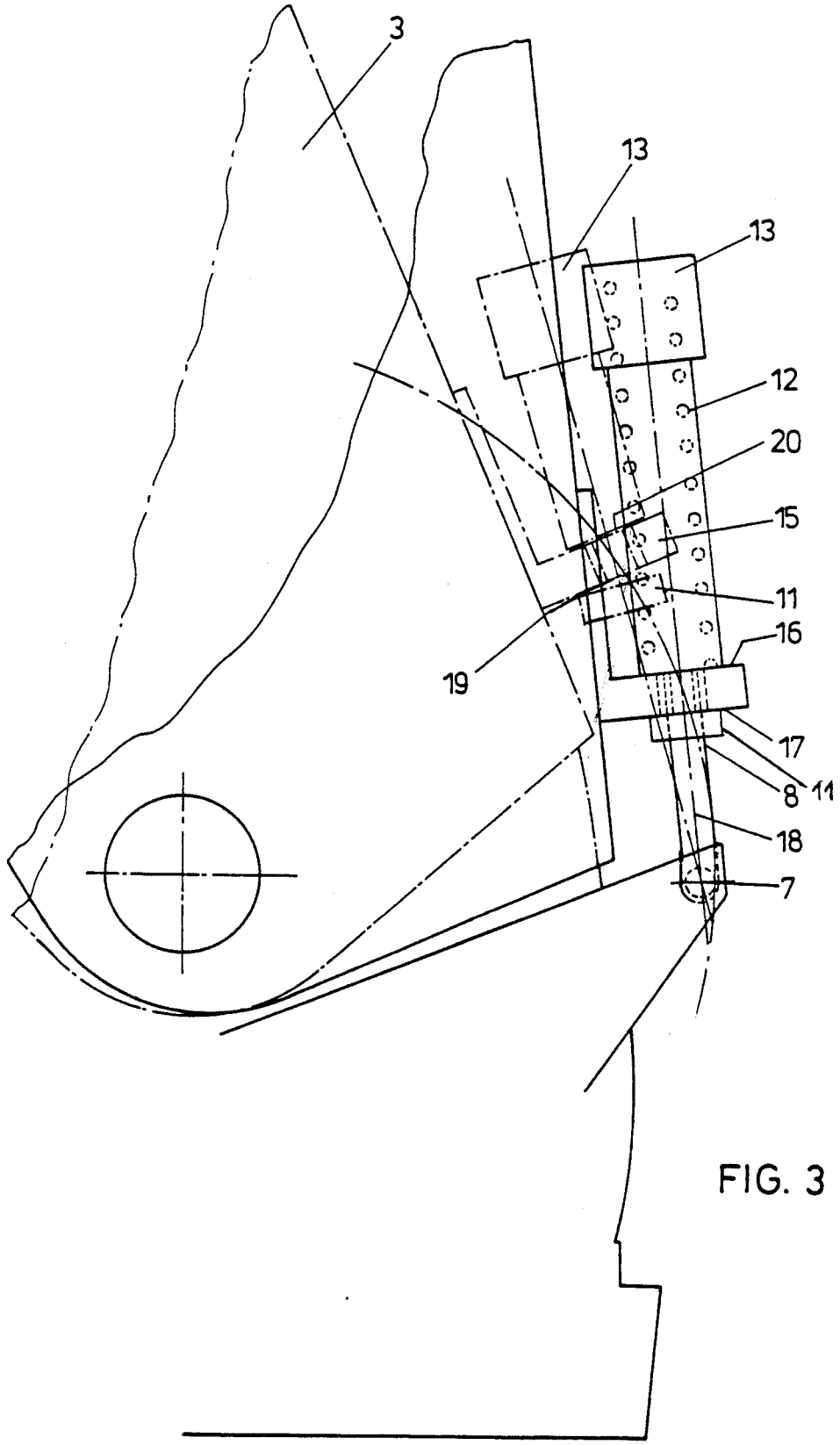

The invention is explained in greater detail below in the drawing with the diagrammatically represented embodiments. In the drawing FIG. 1 shows a ski shoe with a spring member hinged according to the invention in the area of the heel or the Achilles tendon;

FIG. 2 shows an enlarged, diagrammatic representation of hinge kinematics as it results from the use of a second hinge of such a pivotable spring element and FIG. 3 shows a diagrammatic representation of the classic solutions to explain the eccentric forces that occur in this case.

In FIG. 1, with 1 a ski shoe is designated, in which on a shell 2 upper or cuff 3 is pivotably hinged around axis 4. To close the ski shoe three closing members 5 are indicated.

On ski shoe 1 in the heel area to connect shell 2 with pivotable upper or pivotable cuff 3, elastic component 6 is provided which exhibits tension member 8 on shell 2 pivotably attached around axis 7. On pivotable upper or pivotable cuff 3 support surface 10 is attached so that it can be pivoted around axis 9. Tension memnber 8 passes through this support surface 10, and tension member 8 carries a limiting stop that is adjustable for height for limiting the horizontal swing of pivotable upper or cuff 3 into the backward lean position. This stop 11 works together with support surface 10 in the maximum acceptable backward lean position. However, support surface 10 serves at the same time as a spring plate for a spring 12, whose elastic tension is adjustable by knurled nut 13.

In FIG. 2 the conditions in the area of the pivoting places are represented more clearly in a diagrammatic manner. The pivot axis of tension member 8 formed by a rod on shell 2 is again designated with 7. Tension rod 8 carries limiting stop 11 designed as a knurled nut for limiting the swing path into the backward lean. Support surface component 10 is designed as a circular disk, as this is diagrammatically indicated with a dotted line and is supported so that it can be pivoted at pivotable upper or pivotable cuff 3 around pivot axis 9 in enlarged representation around pin 21, and this pivot axis 9 intersects the lengthwise axis of tension member 8. In addition to such a placement of pivot axis 9 intersecting the lengthwise axis of tension member 8, either by corresponding play in the bearing arrangement in bearing block 22 of the cuff or of the upper additional pivotability around a third axis can be allowed so that a kind of Cardan suspension is made possible. Such an additional pivotability, as it can be obtained by the bearing play in the bearing block for example, makes it possible to keep away even additional forces from the bearing block which might be attributed to lateral horizontal swings of the upper, particularly to corresponding tilting-shifting of the upper. In the position represented on the right in FIG. 2 the maximum backward lean position is indicated, as it is given by adjustment of knurled nut 11. In this position the stop formed by knurled nut 11 works extensively together with support surface 10. With a horizontal swing of the cuff or of the pivotable upper into the forward lean position in the direction of arrow 14 surface support 10 can maintain its angular position relative to the axis of tension member 8 because of the pivotability around axis 9, so that also in the position represented on the left in FIG. 2 a spring diagrammatically indicated with 12 again works together in a precisely axial manner with the surface support without side forces.

These conditions are not achieved in a traditional design. In FIG. 3 the support surface on pivotable upper or pivotable cuff 3 is diagrammatically indicated by L-shaped strap 15. Pivot axis 7 on the back end of shell 2 remains unchanged in this case. With a horizontal swing of upper or cuff 3 into the forward lean position the relative angular position between actual support surfaces 16 or 17 of support surface component 15 relative to axis 18 of tension rod 8 is changed. With a corresponding shift of stop 11 for limiting the horizontal swing path into the backward lean this stop 11 can now engage its edge 19 on support surface 15, and between the corresponding surface 17 of support surface 15 and stop 11 a slit tapering in wedge shape is designed so that the total forces must be absorbed eccentrically on edge 19. The same is true for the elastic forces of spring 12, which because of the tilt of corresponding spring plate 20 no longer have any effect on support surface 15 coaxially to axis 18 of tension member 8. A horizontal swing of cuff 3 into the forward lean position in this case leads to deformation forces within the spring because of the tilt of the spring plate, so that with a correspondingly small-sized spring additional friction forces between the tension rod and the inner contour of a correspondingly deformed spring prevent the precise application of elastic forces.

I claim:

1. A ski shoe having a shell and a cuff pivotally hinged to said shell, the shell and cuff being connected in their heel areas by a tension element comprising a spring and a tension member, said tension member being pivotally attached to said shell and extending slidably through a support surface, said spring having one end exerting a force on said support surface and an opposite end exerting an opposing force on said tension member, said support surface being pivotally supported on said cuff on an axis intersecting said tension member.

2. A ski shoe according to claim 1, wherein said support surface is a ring disk.

3. A ski shoe according to claim 1, wherein said support surface engages a stop attached to said tension member for limiting backward lean.

4. A ski shoe according to claim 1, wherein said tension member is a rod resistant to bending.

5. A ski shoe according to claim 3, wherein the height of said stop on said tension member is adjustable.

* * * * *